US005456960A

United States Patent [19]

Ido et al.

[11] Patent Number: 5,456,960

[45] Date of Patent: Oct. 10, 1995

[54] DYED UNION KNIT FABRIC AND METHOD FOR ITS MANUFACTURE

[75] Inventors: Yoshinori Ido; Shuji Chiba; Yoshikazu Arimatsu; Hajime Suzuki, all of Otsu; Takehiko Shimizu, Osaka, all of Japan

[73] Assignee: Toyo Boseki Kabushihi Kaisha, Otsu, Japan

[21] Appl. No.: 278,562

[22] Filed: Mar. 21, 1994

Related U.S. Application Data

[63] Continuation of Ser. No. 801,064, Dec. 3, 1991, abandoned.

[30] Foreign Application Priority Data

Dec. 5, 1990 [JP] Japan ..... 2-406307

[51] Int. Cl.[6] ..... D06P 1/00; D06P 3/00

[52] U.S. Cl. ..... 428/36.1; 428/206; 428/207; 428/224; 428/225; 428/365; 428/423.5; 8/115.7

[58] Field of Search ..... 524/27; 428/365, 428/423.5, 224, 225, 36.1, 206, 207; 8/115.5, 115.7

[56] References Cited

U.S. PATENT DOCUMENTS

| | | | |
|---|---|---|---|
| 2,362,375 | 11/1944 | Heymann . | |
| 3,201,190 | 8/1965 | Carmichael . | |
| 3,809,532 | 5/1974 | Abel . | |
| 4,255,152 | 3/1981 | Hewitt et al. | 8/583 |
| 4,340,527 | 7/1982 | Martin | 524/432 |
| 4,525,420 | 6/1985 | Imai et al. | 428/224 |
| 5,028,642 | 7/1991 | Goodrich et al. | 524/27 |

FOREIGN PATENT DOCUMENTS

| | | |
|---|---|---|
| 2015777 | 4/1970 | France . |
| 0291124 | 11/1989 | Japan . |
| 3334070A1 | 5/1984 | Netherlands . |

OTHER PUBLICATIONS

World Patents Index Latest, Derwent Publications Ltd., London, GB; An 91–234222 & JP–A–03 271 (Sieren K.K.) 28 Jun. 1991 *abstract*.

*Primary Examiner*—Patrick J. Ryan
*Assistant Examiner*—Richard C. Weinberger
*Attorney, Agent, or Firm*—Leydig, Voit & Mayer Ltd.

[57] ABSTRACT

A dyed union knit fabric comprised of at least a polyurethane elastic fiber containing a chlorine-induced degradation inhibitor in a proportion of 0.5–4.5 weight % relative to the weight of the fiber, and a polyamide fiber and/or a cation dyeable polyester fiber, which has been dyed with mixed dyes of acid dyes, dispersion dyes, metal-complex dyes, reactive dyes and direct dyes, and markedly improved in resistance to chlorine-induced change in shade by allowing to contain at least one compound having a reaction amount of chlorine of 50 milliequivalent per gram or more, specifically one member of mono- and/or polyhydroxybenzene derivatives in a proportion of 0.1–20 % relative to the weight of the fiber; and a method for manufacturing same. According to the present invention, excellent resistance to chlorine-induced change in shade as well as chlorine-induced degradation can be afforded to the dyed union knit fabric.

15 Claims, No Drawings

DYED UNION KNIT FABRIC AND METHOD FOR ITS MANUFACTURE

This is a continuation of copending application(s) Ser. No. 07/801,064 filed on Dec. 3, 1991, now abandoned.

FIELD OF THE INVENTION

The present invention relates to a method of dyeing a union knit fabric made with a polyurethane elastic fiber, and a polyamide fiber and/or a cation dyeable polyester fiber, and to a union knit fabric obtained by said method. The present invention specifically relates to a method of dyeing a knit fabric comprised of a polyurethane elastic fiber having improved resistance to chlorine-induced degradation in various chlorinated aqueous environments, which does not impair the improved resistance imparted to the fabric, and to a dyed union knit fabric which retains superior resistance to chlorinated aqueous environments which said method provides.

BACKGROUND OF THE INVENTION

Polyurethane elastic fibers obtained from 4,4'-diphenylmethane diisocyanate, polyhydroxy polymer with a relatively low degree of polymerization, multifunctional active hydrogen compounds, and so on exhibit high rubber elasticity, superior mechanical properties in tensile stress and recoverability, and excellent thermal property. For this reason, they have been given much attention and used as functional materials for clothes such as foundation garments, socks, sportswears, and so on.

However, it has been known that exposure of goods made with elastic fibers which have been formed mainly from long chain synthetic elastic segmented polyurethanes to chlorinated aqueous environments with chlorine bleaching agents can cause considerable lowering of the physical properties of the segmented polyurethane. It has been also known that swimwear made with polyurethane fibers and polyamide fibers is subject to lowered physical properties of the fibers upon long-term exposure to the water in swimming pools containing 0.5–3 ppm (parts per million) active chlorine.

In fact, many attempts have been made so far to impart proof or resistance to chlorine-induced degradation. For example, U.S. Pat. No. 4,340,527 teaches zinc oxide, and Japanese Patent Publication No. 35283/1986 teaches magnesium oxide and alminium oxide as additives which prevent chlorine-induced degradation.

Nevertheless, improvements are still needed since the above-mentioned polyurethane elastic fiber containing a chlorine-induced degradation inhibitor, which is used to manufacture union knit fabric loses most of the resistance to chlorine after dyeing, etc., because the degradation inhibitor once contained in the fiber elutes out during dyeing, finishing and processing stages, particularly during the dyeing process which the goods made of the union knit fabric undergo, due to a low pH of dye liquor despite the resistance to chlorine which the raw fiber possesses.

The present invention provides resistance to the chlorinated water to the dyed textile goods made with at least a polyurethane elastic fiber, and a method for manufacturing them, thereby resolving the problems of the prior art as described above.

That is, the present invention relates to a dyed union knit fabric comprised of at least a polyurethane elastic fiber, and a polyamide fiber and/or a cation dyeable polyester fiber, wherein the polyurethane elastic fiber contains one or more from among magnesium oxide, zinc oxide, alminium oxide, magnesium hydroxide, zinc hydroxide, alminium hydroxide and hydrotalcite compounds of $Mg_xAl_y(OH)_zCO_3 \cdot IH_2O$ in a proportion of 0.5–4.5 weight %. Also, the present invention relates to a method for manufacturing a dyed union knit fabric wherein pH of dye liquor is maintained at not less than 4.5 from the beginning to the end of dyeing process for the union knit fabric comprised of at least a polyurethane elastic fiber containing one or more of the above-mentioned compounds in a proportion of 0.5–5.0 weight %, and a polyamide fiber and/or a cation dyeable polyester fiber, with the use of acid dyes, metal-complex dyes, fluorescent dyes, disperse dyes, or the like.

The polyurethane elastic fiber used in the present invention is an elastic fiber obtained by spinning a polymer composition containing a polyurethane to be mentioned below as a main component.

As the polyurethane in the present invention, usable are polymers obtained by reacting a polymer diol having a number average molecular weight of not less than 600, preferably 1000–5000 and a melting point of not more than 60° C., an isocyanate based on an organic diisocyanate, and a multifunctional active hydrogen compound having a molecular weight of not more than 400.

Examples of the polymer diol include polyether glycols such as polytetramethylene ether glycol and polyethylene propylene ether glycol; polyester glycols obtained by reacting at least one member of glycols such as ethylene glycol, 1,6-hexane diol, 1,4-butane diol and neopentyl glycol with at least one member of dicarboxylic acids such as adipic acid, suberic acid, azelaic acid, sebacic acid, β-methyladipic acid and isophthalic acid; polycaprolactone glycol; polyhexamethylene dicarbonate glycol; and mixtures and copolymers of two or more of them.

Examples of the organic diisocyanate include 4,4'-diphenylmethane diisocyanate, 1,5-naphthalene diisocyanate, 1,4-phenylene diisocyanate, 2,4-tolylene diisocyanate, hexamethylene diisocyanate, 1,4-cyclohexane diisocyanate, 4,4'-dicyclohexylmethane diisocyanate, isophorone diisocyanate, and mixtures of two or more of them. A small amount of triisocyanate may be co-used.

Examples of the multifunctional active hydrogen compounds include ethylenediamine, 1,2-propylenediamine, hexamethylenediamine, xylylenediamine, 4,4'-diphenylmethanediamine, hydrazine, 1,4-diaminopiperazine, ethylene glycol, 1,4-butanediol, 1,6-hexanediol, water, and mixtures of two or more of them. A small amount of a terminator such as monoamine or monoalcohol may be added to the above-mentioned compounds, if desired. Of those, preferred is diamine solely or one based on diamine.

The way of forming an elastic fiber by spinning a composition based on polyurethane is not subject to particular limitation, but dry spinning of a composition based on polyurethane, which is dissolved in a solvent is preferable. As the solvent, there may be exemplified, but not limited to, N,N-dimethylformamide, N,N-dimethylacetamide, tetramethylurea and hexamethylphosphoramide. The components other than polyurethane to be contained in the composition based on polyurethane include chlorine-induced degradation inhibitors such as metal oxides and metal hydroxides (e.g. magnesium oxide, zinc oxide, alminium oxide, magnesium hydroxide, zinc hydroxide, alminium hydroxide, hydrotalcite compounds) which may be used solely or in combination, with preference given to magnesium oxide and zinc oxide. The way of adding an inhibitor into the polyurethane solution is not particularly limited, but preferably performed by adding same in finely divided particles having an average diameter of 0.05–3 μm. The chlorine-induced degradation inhibitor such as metal oxide, etc. is added in a proportion of 0.5–5.0 weight %, preferably 1.0–3.0 weight % based on the polyurethane. The proportion of the residual magnesium oxide, etc. relative to the polyurethane after dyeing is 0.5–4.5 weight %, preferably 1.0–4.5 weight %, more preferably 2.0–4.0 weight %.

The polyurethane elastic fiber in accordance with the present invention is of 20–100 denier, preferably 40–80 denier. The elastic fiber is used in the state of covering yarn or bare yarn.

The polyamide fiber to be knitted with the polyurethane elastic fiber of the present invention is not particularly limited and exemplified by nylon 6 and nylon 6,6.

Similarly, the cation dyeable polyester fiber is not particularly limited and can be a fiber obtained from polyesters prepared by copolymerization of an ester-forming compound having a sulfo group such as 5-sulfoisophthalic acid with a conventional polyester, or copolymerization along with another ester-forming compound, wherein the sulfo group preferably forms a metal salt such as sodium salt. This cation dyeable polyester fiber can dye in sufficiently deep shade with cation dyes at a temperature of not more than 100° C.

The union knit fabric is subject to no particular limitation and may be a weft-knitted fabric, a warp-knitted fabric, a tricot fabric or a raschel fabric. Its stitch may be half stitch, back half stitch, double atlas stitch, double dembhigh stitch, or the like with no particular limitation. From the standpoint of handling touch, the surface of the fabric is preferably made with a polyamide fiber and/or a cation dyeable polyester fiber.

The knit fabric is subjected to scouring, relaxing and drying under the usual conditions, in which heat setting temperature is between 150° C. and 190° C., preferably between 160° C. and 180° C.

Dyeing is done in a dye bath for 20–120 minutes, preferably for 40–60 minutes.

The dyeing machine is one usually employed, such as wince dyeing machine and liquor flow dyeing machine. The dyestuff to be used is one normally employed by dye makers for dyeing polyamide fibers or for dyeing cation dyeable polyester fibers, such as acid dyes, metal-complex dyes, fluorescent dyes, disperse dyes, cation dyes, and so on.

The polyamide fiber and/or the cation dyeable polyester fiber of the present invention exhaust(s) and/or show(s) a dye uptake of not less than 0.01% owf, preferably 0.05% owf, more preferably 0.1% owf relative to the union knit fabric of at least one of the above dyes.

In the present invention, it is essential that pH of dye liquor be maintained at 4.5 or above, preferably at 5 from the initiation to the termination of dyeing, and for this to be achieved, for example, an organic acid ester is added to the dye liquor.

In the organic acid ester are formate, acetate, butyrate, lactate and orthoformate. An alkali agent such as soda ash may be used along with the organic acid ester. The organic acid ester is used in a proportion of 0.1–10 weight %, preferably 1–5 weight % based on the weight of the fabric. The preferable organic acid ester is orthoformate.

The orthoformate is exemplified by trimethyl orthoformate and triethyl orthoformate, with preference given to trimethyl orthoformate. The orthoformate is used in a proportion of 0.01–10 weight %, preferably 0.5–5 weight % based on the weight of the fabric. Where it is used in a proportion of less than 0.01 weight %, sufficient dyeing is unattainable, while used in more than 10 weight %, the chlorine-induced degradation inhibitor elutes out in a large amount, resulting in marked lowering of product properties. An alkali agent such as soda ash may be used along with the orthoformate.

An ester of formic acid and an alkylene glycol having an alkylene of 2 to 5 carbon atoms may be used for maintaining the pH of die liquor not less than 4.5. In such ester are monoesters and diesters of formic acid and ethylene glycol, and mixtures thereof; and monoesters and diesters of formic acid and propylene glycol, and mixtures thereof, with preference given to monoesters and diesters of formic acid and ethylene glycol, and mixtures thereof. The ester of formic acid and an alkylene glycol having an alkylene of 2 to 5 carbon atoms may be used in a proportion of 0.01–3.0 weight %, preferably 0.1–1.0 weight % based on the weight of the fabric. Where it is used in a proportion of less than 0.01 weight %, sufficient dyeing is unattainable, while used in more than 3.0 weight %, the chlorine-induced degradation inhibitor elutes out in a large amount, resulting in marked lowering of product properties. An alkali agent such as soda ash may be used along with the ester of formic acid and an alkylene glycol having an alkylene of 2 to 5 carbon atoms.

The present invention aims at imparting resistance to chlorine-induced degradation to a polyurethane elastic fiber while imparting resistance to change in shade to a dyed union knit fabric made with said elastic fiber.

It has been known that products dyed with mixed dyes of acid dyes, dispersion dyes, metal-complex dyes, reactive dyes and direct dyes are susceptible to shade change in chlorlnated environments. In particular, a long-term exposure of a union knit fabric made with a polyurethane elastic fiber and a polyamide synthetic fiber, and dyed with acid dyes, dispersion dyes, metal-complex dyes or reactive dyes to the chlorinated water containing 0.5–3 ppm active chlorine such as the water in swimming pools results in decoloring, yellowing and saddening of the shade of the fabric particularly when the fabric has been dyed in fluorescent or brilliant shades.

In view of the above situation, the present inventors have conducted intensive studies based on a new idea and as a result, achieved the present invention which remarkably resolves various problems as described.

That is, the present invention provides a union knit fabric comprised of at least a polyurethane elastic fiber, and a polyamide fiber and/or a polyester fiber, which has been dyed with mixed dyes of acid dyes, dispersion dyes, metal-complex dyes, reactive dyes and direct dyes, and markedly improved in resistance to chlorine-induced change in shade in various chlorinated environments without impairing the original color of the fabric by allowing to contain at least one compound having a reaction amount of chlorine of 50 milliequivalent per gram or more, specifically one member of mono- and/or polyhydroxybenzene derivatives of the following formula 1, 2 or 3 in a proportion of 0.1–20% relative to the weight of the fiber via immersion in a hot bath, and a method for manufacturing it. In addition to the resistance to chlorine-induced degradation, resistance to chlorine-induced change in shade can be increased by blending said compounds during dyeing and/or before and after the dyeing.

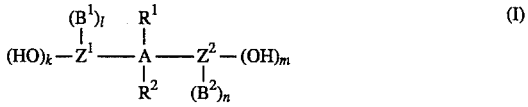

(I)

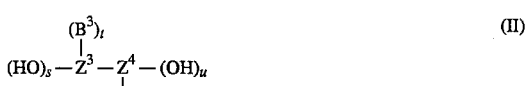

(II)

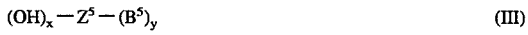

(III)

wherein $Z^1$ is an aromatic group; $Z^2$, $Z^3$, $Z^4$ and $Z^5$ are independently aromatic groups the same as or different from $Z^1$; A is a bivalent group such as alkylene, sulfonyl, sulfide and azo; $B^1$ is a monovalent group such as alkyl, alkoxy, nitro, sulfone and amino, or hydrogen atom; $B^2$, $B^3$, $B^4$ and $B^5$ are independently monovalent groups the same as or different from $B^1$, or hydrogen atom; $R^1$ and $R^2$ are the same or different and each is a group selected from the group consisting of alkyl and aryl; and k, l, m, n, s, t, u, v, x and y are positive integers satisfying the following formulas Q-1 to Q-5.

| | | |
|---|---|---|
| $0 \leqq k \leqq 4$ | $1 \leqq k+l \leqq 5$ | (Q-1) |
| $0 \leqq m \leqq 4$ | $1 \leqq m+n \leqq 5$ | (Q-2) |
| $0 \leqq s \leqq 4$ | $1 \leqq s+t \leqq 5$ | (Q-3) |
| $0 \leqq u \leqq 4$ | $1 \leqq u+v \leqq 5$ | (Q-4) |
| $1 \leqq x \leqq 4$ | $1 \leqq x+y \leqq 6$ | (Q-5) |

Each symbol in formulas (I) to (III) represents the following.

As regards $Z^1$, $Z^2$, $Z^3$, $Z^4$ and $Z^5$, the aromatic group means phenylene group such as 1,4-phenylene, 1,3-phenylene and 1,2-phenylene, naphthylene group such as 1,4-naphthylene, 1,5-nephthylene and 1,6-naphthylene.

As regards A, the alkylene group has 1 to 20, preferably 1 to 10 carbon atoms, which is exemplified by methylene, ethylene, propylene, trimethylene, vinylene, ethynylene and propenylene.

As regards B, the alkyl group has 1 to 10, preferably 1 to 5 carbon atoms, which is exemplified by methyl, ethyl, propyl, isopropyl, butyl and t-butyl.

As regards B, the alkoxy group has 1 to 10, preferably 1 to 5 carbon atoms, which is exemplified by methoxy, ethoxy, propoxy, isopropoxy and butoxy.

As regards $R^1$ and $R^2$ , the alkyl group has 1 to 10, preferably 1 to 5 carbon atoms, which is exemplified by methyl, ethyl, propyl, isopropyl, butyl and t-butyl.

As regards $R^1$ and $R^2$, the aryl group is exemplified by phenyl, tolyl, xylyl, biphenyl and naphthyl.

The compounds of formula (I) may be exemplified by diphenylmethane derivatives into which a hydroxyl group has been introduced, such as 4,4'-methylenebisphenol, 4,4'-(1-methylethylidene)bisphenol, 4,4'-ethylidenebisphenol, 4,4'-(1-α-methylbenzylidene)bisphenol, 4,4'-cyclohexylidenebisphenol, 4,4'-[1[4-[2-(4-hydroxyphenyl)-2-propyl] phenyl] ethylidene]bisphenol, 4,4'-[(4-hydroxyphenyl)methylene]bis(methylphenol), 4,4'-[(4hydroxyphenyl)methylene] bis(2,6-dimethylphenol), 4,4'-methylenebis(2,6-dimethylphenol), 4,4'-(1-methylethylidene)bis(2-methylphenol), 4,4',4"-ethylidinetrisphenol, 4,4',4"-methylidinetrisphenol, 2,2'-methylenebis(4-methylphenol), 4,4'-(1-methylethylidene)bis(2,6-dimethylphenol), phenolphthalein, 1,4-phenylene-4,4'-bisphenol, 1,4-bis(4-hydroxyphenyl)cyclohexane, bis(3,5-dihydroxyphenyl)methane, 2,2'-bis(4-hydroxynaphthyl)methane, 2,2'-bis(5-hydroxynaphthyl)methane, 2,2'-bis(6-hydroxynaphthyl)methane, 2,2'-bis(7-hydroxynaphthyl)methane, 2,2'-bis(8-hydroxynaphthyl)methane, 2,2'-bis-(4,7-dihydroxynaphthyl)methane, 2,2'-bis(3,6-dihydroxynaphthyl)methane, and polymers obtained by using them as monomers; diphenylsulfone derivatives into which a hydroxyl group has been introduced, such as bis(4-hydroxyphenyl)sulfone and bis(3,5-dihydroxyphenyl-)sulfone, and polymers obtained by using them as monomers; diphenylsulfid derivatives into which a hydroxyl group has been introduced, such as 4,4'-dihydroxydiphenylsulfid and bis(3,5-dihydroxyphenyl)sulfid, and polymers obtained by using them as monomers; diphenylether derivatives into which a hydroxyl group has been introduced, such as 4,4'-dihydroxydiphenyl ether and bis(3,5-dihydroxyphenyl) ether, and polymers obtained by using them as monomers; and azobenzene derivatives into which a hydroxyl group has been introduced, such as 4,4'-dihydroxyazobenzene and bis(3,5-dihydroxy)azobenzene, and polymers obtained by using them as monomers.

Examples of the compounds of formula (II) include biphenyl derivatives into which a hydroxyl group has been introduced, such as 2-phenylphenol, 3-phenylphenol, 4-phenylphenol, 3,3'-dihydroxybiphenyl, 4,4'-dihydroxybiphenyl, 3,5-dihydroxybiphenyl, 2,4-dihydroxybiphenyl, 2,2'-dihydroxybiphenyl, 2,3'-dihydroxybiphenyl, 3,5,4'-trihydroxybiphenyl, 2,4,4'-trihydroxybiphenyl, 2,6,4'-trihydroxybiphenyl, 3,3',5,5'-tetrahydroxybiphenyl, and polymers obtained by using them as monomers; and binaphthyl derivatives into which a hydroxyl group has been introduced, such as 2,2'-bis(4-hydroxynaphthyl), 2,2'-bis(5-hydroxynaphthyl), 2,2'-bis(6-hydroxynaphthyl), 3,3'-bis(6-hydroxynaphthyl), 2,2'-bis(8-hydroxynaphthyl), 1,1'-bis(3-hydroxynaphthyl), 1,1'-bis(4-hydroxynaphthyl), 1,1'-bis(5-hydroxynaphthyl), 1,1'-bis(6-hydroxynaphthyl), 1,1'-bis(7-hydroxynaphthyl), 1,1'-bis(8-hydroxynaphthyl), and polymers obtained by using them as monomers.

Examples of the compounds of formula (III) include 3-hydroxybenzoic acid and/or its methyl, ethyl, isopropyl, t-butyl, amyl and stearyl esters using the 3-hydroxybenzoic acid as an acid component, and polymers obtained by using them as monomers; 4-hydroxybenzoic acid and/or its methyl, ethyl, isopropyl, t-butyl, amyl and stearyl esters using the 4-hydroxybenzoic acid as an acid component, and polymers obtained by using them as monomers; 3,5-dihydroxybenzoic acid and/or its methyl, ethyl, isopropyl, t-butyl, amyl and stearyl esters using the 3,5-hydroxybenzoic acid as an acid component, and polymers obtained by using them as monomers, 2,4-dihydroxybenzoic acid and/or its methyl, ethyl, isopropyl, t-butyl, amyl and stearyl esters using the 2,4-hydroxybenzoic acid as an acid component, and polymers obtained by using them as monomers; hydroxyacetophenones such as 3-hydroxyacetophenone, 4-dihydroxyacetophenone, 3,5-dihydroxyacetophenone and 2,4-dihydroxyacetophenone, and polymers obtained by using them as monomers; hydroxybenzyl ketones such as 3-hydroxybenzyl ethyl ketone, 4-hydroxybenzyl ethyl ketone, 3-hydroxybenzyl isopropyl ketone, 4-hydroxybenzyl isopropyl ketone, 3-hydroxybenzyl butyl ketone, 4-hydroxybenzyl butyl ketone, 3-hydroxybenzyl amyl ketone, 4-hydroxybenzyl amyl ketone, 4-hydroxybenzyl stearyl ketone and 3-hydroxybenzyl stearyl ketone, and polymers obtained by using them as monomers; and alkylphenols such as isopropylphenol, butylphenol and amylphenol, and polymers obtained by using them as monomers.

Of the polymers obtained by using mono- and/or polyhydroxybenzene derivatives of formula 1, 2 or 3 as monomers, a polymer wherein aromatic ring is directly bound with aromatic ring, which can be produced by oxidative coupling of the monomers, is preferable. Such a polymer can be produced by a well-known method such as an oxidative coupling of phenol compounds by horse-radish peroxidase. A formalin condensate obtained from the phenol compounds described above, such as the conventional novolak resin may be used.

A method for determining the amount of chlorine reacting with the compounds to be added for the improved resistance to chlorine-induced shade change is as follows.

Determination of reaction amount of chlorine

The determination method for the reaction amount of chlorine (hereinafter referred to as C) is described in the following, wherein % means weight %.

(1) Reagent and its preparation i) Sodium hypochlorite solution Sodium hypochlorite (guaranteed reagent, 30 g) (Nakarai Tesque) is diluted with pure water to give a 1 l solution.

ii) Diluted aqueous solution of acetic acid (10%) Acetic acid (5 g) is diluted with pure water to make the total amount 50 g.

iii) Starch indicator (5%) Soluble starch (1 g, Nakarai Tesque) is dissolved in pure water to make the total amount 20 g.

iv) Acetic acid A guaranteed reagent (Nakarai Tesque) is used as it is.

v) Aqueous solution of potassium iodide (20%) Potassium iodide (guaranteed reagent, 100 g) (Nakarai Tesque) is dissolved in pure water to make the total amount 500 g.

vi) N/10 Sodium thiosulfate normal solution A normal solution (Nakarai Tesque) is used as it is. (Potency of the normal solution: f)

vii) Solvent A suitable solvent is selected according to the properties of the substance to be determined for the reaction amount of chlorine (hereinafter referred to as sample).

In the present invention, chloroform; methaol, ethanol, isopropyl alcohol, methyl isopropyl ketone (all of which are guaranteed reagents produced by Nakarai Tesque) and pure water are used as they are and/or in mixture.

(2) Preparation of sample solution

A given amount of a sample (S gram, preferably about 0.1 g) is precisely weighed with a chemical balance, and dissolved in a solvent which is selected in (1)-vii) in a 100 ml-volumetric flask to make the total amount 100 mi.

(3) Instruments to be used (the figure in parentheses refer to instrument number)

i) 25 ml buret (1)

ii) pipet 25 ml (1), 10 ml (2), 5 ml (1), 2 ml (1)

iii) measuring pipet 10 ml (1)

iv) Erlenmeyer's flask with a plug 100 ml (determination number +2 for blank test)

v) magnetic stirrer, stirring rod (same as the number of Erlenmeyer's flask)

vi) clock (1)

(4) Determination procedure for reaction amount of chlorine i) N/10 sodium thiosulfate is charged in a 25 ml buret.

ii) With the use of a 25 ml pipet, a sodium hypochlorite solution is dispensed in the 100 ml Erlenmeyer's flasks to be used for the determination, each of which being equipped with a stirring rod. Two flasks are prepared for the blank test.

iii) The sample solution is dispensed in the Erlenmeyer's flasks of ii) with a 10 ml pipet. The solvent is dispensed by 10 ml in the flasks for the blank test.

iv) A 10%-diluted aqueous solution of acetic acid is added to each Erlenmeyer's flask by 1 ml, with a 10 ml measuring pipet while stirring. The time clocking is initiated from the moment when the diluted aqueous solution of acetic acid is added, which moment is taken as minute 0.

v) After a given time, one Erlenmeyer's flask is taken, and 5 ml of an aqueous solution of 20% potassium iodide and then 2 ml of acetic acid are added. The reaction time is normally set for 5, 10, 20, 30 and 40 minutes.

vi) A sodium thiosulfate normal solution is dropwise added thereto under stirring until the solution in the flask loses most of its color. Several drops of an starch indicator are added, and the dropwise addition is continued until the purple color completely disappears. The point at which the purple color disappears is taken as titration end point. The same procedure is repeated at each predetermined time period to measure the titre. (titre: V ml)

vii) As the blank test, titration is conducted immediately after the addition of the diluted acetic acid and at each time period predetermined for the titration of the sample in vi). These two titres are averaged to give the titre of the blank (Vo ml).

(5) Calculation of reaction amount of chlorine (C)

i) The correlation of x and y is calculated from the following equation (1) by the least square method, wherein x is reaction time and y is Vo-V of each reaction period:

$$y=a+bx \text{ (correlation function: r)} \quad (1)$$

The correlation coefficient of the straight line is preferably 0.98 or above for the determination precision.

ii) The value C is calculated from the following equation (2) using an extrapolation value, namely a, which is the value of the straight line obtained when the reaction time (x) is 0:

$$C=a\times f+S \quad (2)$$

[unit of C:milliequivalent per gram, f:potency of N/10 sodium thiosulfate normal solution, S:amount of sample (g)]

As the compounds whose reaction amount of chlorine is 50 milliequivalent per gram or more, there may be mentioned those exemplified as the compounds of formula 1, 2 and 3 as shown above, with preference given to 4,4'-biphenol, Bisphenol A and 4,4'-dihydroxydiphenyl sulfone.

Note that of the compounds having the reaction amount of chlorine of 50 milliequivalent per gram or more as measured by the above method, hydroxybenzophenone derivatives, catechols, pyrogallols and gallates are not preferable, since they themselves have colors. As the polyhydroxybenzene derivatives in the present invention, those having a hydroxyl group at the ortho- and/or para-position(s) which develop color by reacting with basic additives contained in polyamide fiber and/or polyester fiber, and polyurethane elastic fiber to form a quinone structure, such as hydroquinone, catechol and pyrogallol are not preferable from the standpoint of hue of the dyed fabric, and polyhydroxybenzene derivatives which do not take a quinone structure when oxidized, such as phenol, resorcin and phloroglucin are preferable. The proportion of the chlorine-induced shade change inhibitor to be contained in the knit fabric is in the range of 0.1 to 20 weight %, preferably 0.5–10 weight %. Where it is contained in a proportion below said range, the effect is seldom observable, while contained beyond said range, handling touch becomes undesirable.

The use of an anionic phenol compound which does not take a quinone structure by reacting with an alkali, as a dye fixing agent during dye fixing of the fabric benefits the object of the invention.

The dye fixing agent to be used in the present invention is an anionic phenol compound which does not take a quinone structure by reaction with an alkali. Examples of the phenol compound include phenolsulfonic acid-formaldehyde resin, sulfone compounds of novolak type resin, methane sulfonic acid of novolak type resin, benzylated phenolsulfonic acid, thiophenol compounds, dihydroxydiphenyl sulfone compounds, ligand compounds thereof and metal chelate compounds thereof. The anionic phenol compound is used in a proportion of 1–20% owf (on the weight of fiber), preferably 3–10% owf based on the polyamide fiber. Where it is contained in a proportion of 1% or below, durable dye fixation cannot be obtained, while contained in a proportion of 20% owf or above, handling touch becomes firm and undesirable despite sufficient fixation effect.

The anionic phenol compound is applied on the fabric by immersing the dyed knit fabric in a solution of an anionic phenol compound, padding a solution of an anionic phenol compound on the knit fabric, or spraying same on the knit fabric, of which the immersion is most desirable since it permits efficient application of the dye fixing agent on the knit fabric by the least number of steps including dye finishing, and it results in homogeneous application of the agent. The dye fixation temperature is in the range of 40° C. to 100° C., preferably 60° to 90° C. Resin treatment agents, softners, antistatic agents, water repellents, etc. may be added in the solution to be used for immersion, padding or spraying according to the present invention. Orthoformate is co-used in the dye fixation mentioned above.

Unless the dye method of the present invention is employed, prevention of chlorine-induced degradation in the dyed final product becomes ineffective due to the reduced amount of the degradation inhibitor which was once contained in the fiber during spinning.

The present invention is hereinbelow described in detail by illustrating working examples and comparative examples in which % means weight % unless otherwise specified.

Example 1–4, Comparative Example 1–3

A prepolymer was prepared by reacting polytetramethylene ether glycol having a hydroxyl group on the both termini which has a number average molecular weight of 2000 with 4,4'-diphenylmethane diisocyanate in a molar ratio of 1:2. The prepolymer thus prepared was then subjected to chain extension with 1,2-propylenediamine to give a polyurethane solution of 30% polymer concentration (solvent: dimethylformamide) and 2000 poises viscosity at 30° C. To this solution were added magnesium oxide having an average particle diameter of 0.1–2.0 μm dispersed in dimethylformamide by attriter, in a proportion of 3% based on the polyurethane, then antioxidant, ultraviolet absorber and gas yellowing-preventive, and the mixture was stirred to give a spinning dope.

After defoaming, the spinning dope was extruded into a spinning chimney in a heated air flow (180° C.) from a five-hole spinneret (hole diameter: 0.2 mm). The yarns were twisted at 10000 rpm, and wound at a rate of 500 m/min. while applying 6% winding oil to the yarns, thereby obtaining five-filament, 40 denier polyurethane elastic fiber (A). For comparison, polyurethane elastic fiber (A2) was obtained in the same manner as for (A) with no addition of magnesium oxide. Besides, 12-filament, 50 denlet fiber (B1) was prepared from nylon 6. Using the tricot knitting machine (28 gauge, Karlmeyer), the gray state goods were prepared.

The draft of fibers (A) and (A2) was 100%, knit-in length was 70 cm/480 course for fibers (A) and (A2), and 160 cm/480 course for fiber (B1) (55 looming course), and the stitch was half stitch.

Each of the knit fabrics obtained from fibers (A) and (B1), or (A2) and (B1) in the gray state was subjected to scouring, relaxing, drying and heat setting, followed by dyeing.

Dyeing was done using Kayacyl Blue BR, 5.0% owf (acid dye) at 40°–95° C. for 45 minutes. The knit fabric was rinsed with warm water at 50° C. for 10 minutes, and successively dye fixed, after which it was centrifugally dehydrated, squeezed with mangle, dried in pin tenter at 180° C. for 30 seconds and heat-set.

The chlorine-induced degradation of each knit fabric thus obtained was tested, in which the fabric was 40% warpwise drawn and immersed in chlorinated water (pH 7.5, 30° C., 30 ppm) for 6 hours, and stress before and after the immersion was measured to determine the degradation (brittleness), the results of which are summarized in Table 1.

TABLE 1

| | Ex. 1 | Ex. 2 | Ex. 3 | Ex. 4 | Comp. Ex. 1 | Comp. Ex. 2 | Comp. Ex. 3 |
|---|---|---|---|---|---|---|---|
| elastic fiber used | (A) | (A) | (A) | (A) | (A) | (A) | (A2) |
| dye liquor formulation | A | B | C | D | E | F | A |
| initial pH | 8.1 | 9.1 | 9.0 | 8.5 | 4.2 | 3.7 | 8.1 |
| final pH | 5.0 | 7.2 | 7.1 | 5.3 | 7.9 | 5.1 | 4.8 |
| residual MgO (%) | 2.5 | 2.7 | 2.6 | 2.4 | 0.3 | 0.2 | — |
| chlorine-induced degradation | none | none | none | none | yes | yes | yes |

In Table 1, A to F under "dye liquor formulation" refer to the aforementioned dye liquor supplemented with the following agents.

A: NC Acid W (Nikka Kagaku) 2 g/l

B: Sand Acid V (Sand) 2 g/l Soda ash 0. 3 g/l

C: Sand Acid VA (Sand) 2 g/l Soda ash 0. 3 g/l

D: Sand Acid VSK (Sand) 2 g/l Soda ash 0.3 g/l

E: Acetic acid 0.4 g/l Ammonium sulfate 2 g/l Anionic leveling agent 1.2 g/l

F: Acetic acid 1.0 g/l Ammonium sulfate 2 g/l Anionic leveling agent 1.2 g/l

Example 5–7, Comparative Example 4–8

The following test was performed using the same fiber and the knit fabric as used in Examples 1–4.

The fabric was dyed with Kayacyl Blue BR, 5% owf (acid dye) at from 40° C. to 95° C. for 45 minutes and at 95° C. for 30 minutes (liquor ratio: 13:1), then rinsed with warm water at 50° C. for 10 minutes, followed by dye fixing. Thereafter, the fabric was centrifugally dehydrated, squeezed with mangle, dried in pin tenter at 180° C. for 30 seconds and heat-set.

For textile printing, the fabric was dyed with fluorescent dyes under the same conditions as above, and subjected to printing, steaming at 100° C. for 40 minutes, and rinsing with water, alkali soaping, rinsing with warm water and rinsing with water, which steps were repeated in cycles. Upon dye fixation, the fabric was dehydrated, spread, dried at 160° C. for 30 seconds and heat-set. (Example 7)

The chlorine-induced degradation of each knit fabric thus obtained was tested, in which the fabric was 40% warpwise drawn and immersed in chlorinatcd water (pH 7.5, 30° C., 30 ppm) for 6 hours, and stress before and after the immersion was measured to determine the degradation (brittleness), the results of which are summarized in Table 2.

TABLE 2

| | Ex. 5 | Ex. 6 | Ex. 7 | Comp. Ex. 4 | Comp. Ex. 5 | Comp. Ex. 6 | Comp. Ex. 7 | Comp. Ex. 8 |
|---|---|---|---|---|---|---|---|---|
| elastic fiber used | (A) | (A) | (A) | (A) | (A) | (A) | (A2) | (A) |
| dye liquor formulation | A | B | G | C | D | E | F | H |
| residual MgO (%) | 2.5 | 2.7 | 2.6 | 0.2 | 2.6 | 0.3 | — | 0.2 |
| dyeability | sufficient | sufficient | sufficient | sufficient | insufficient | sufficient | sufficient | sufficient |
| chlorine-induced degradation | none | none | none | yes | none | yes | yes | yes |

In Table 2, A to F under "dye liquor formulation" refer to the aforementioned dye liquor supplemented with the following orthoformate and/or other agents. G and H refer to printing with a color paste supplemented with the following orthoformate or acetic acid. In Comparative Example 5, dyeing was insufficient, namely, dye exhaustion was 0.01% owf or below.

A: Trimethyl orthoformate 1 g/l

B: Trimethyl orthoformate 1 g/l Soda ash 0.1 g/l

C: Acetic acid 0.4 g/l Ammonium sulfate 2 g/l Anionic leveling agent 1.2 g/l

D: Trimethyl orthoformate 0.005 g/l

E: Trimethyl orthoformate 10 g/l

F: Trimethyl orthoformate 1 g/l

G: Trimethyl orthoformate 1 g/l (printing)

H: Acetic acid 0.4 g/l

Example 8–10, Comparative Example 9–13

The following test was performed using the fiber and the knit fabric as obtained in Examples 1–4 and Comparative Example 1–3.

The fabric was dyed with Kayacyl Blue BR, 5% owf (acid dye) at from 40° C. to 95° C. for 45 minutes and at 95° C. for 30 minutes (liquor ratio: 13:1), then rinsed with warm water at 50° C. for 10 minutes, followed by dye fixing. Thereafter, the fabric was centrifugally dehydrated, squeezed with mangle, dried in pin tenter at 180° C. for 30 seconds and heat-set.

For textile printing, the fabric was dyed with fluorescent dyes under the same conditions as above, and subjected to printing, steaming at 100° C. for 40 minutes, and rinsing with water, alkali soaping, rinsing with warm water and rinsing with water, which steps were repeated in cycles. Upon dye fixation, the fabric was dehydrated, spread, dried at 160° C. for 30 seconds and heat-set. (Example 10)

The chlorine-induced degradation of each knit fabric thus obtained was tested, in which the fabric was 40% warpwise drawn and immersed in chlorinated water (pH 7.5, 30° C., 30 ppm) for 6 hours, and stress before and after the immersion was measured to determine the degradation (brittleness), the results of which are summarized in Table 3.

TABLE 3

| | Ex. 8 | Ex. 9 | Ex. 10 | Comp. Ex. 9 | Comp. Ex. 10 | Comp. Ex. 11 | Comp. Ex. 12 | Comp. Ex. 13 |
|---|---|---|---|---|---|---|---|---|
| elastic fiber used | (A) | (A) | (A) | (A) | (A) | (A) | (A2) | (A) |
| dye liquor formulation | A | B | G | C | D | E | F | H |
| residual MgO (%) | 2.3 | 2.6 | 2.4 | 0.2 | 2.5 | 0.2 | — | 0.2 |
| dyeability | sufficient | sufficient | sufficient | sufficient | insufficient | sufficient | sufficient | sufficient |
| chlorine-induced degradation | none | none | none | yes | none | yes | yes | yes |

In Table 3, A to F under "dye liquor formulation" refer to the aforementioned dye liquor supplemented with the following ester of formic acid and alkylene glycol having an alkylene of 2 to 5 carbon atoms and/or other agents. G and H refer to printing with a color paste supplemented with the following ester of formic acid and alkylene glycol having an alkylene of 2 to 5 carbon atoms or acetic acid. In Comparative Example 10, dyeing was insufficient, namely, dye exhaustion was 0.01% owf or below.

A: Ethylene glycol monoformate 1 g/l

B: Ethylene glycol monoformate 1 g/l Soda ash 0.1 g/l

C: Acetic acid 0.4 g/l Ammonium sulfate 2 g/l Anionic leveling agent 1.2 g/l

D: Ethylene glycol monoformate 0.005 g/l

E: Ethylene glycol monoformate 10 g/l

F: Ethylene glycol monoformate 1 g/l

G: Ethylene glycol monoformate 1 g/l (Example 10)

H: Acetic acid 0.4 g/l

Example 11–13, Comparative Example 14–19

The following test was performed using the fiber and the knit fabric as obtained in Example 1–4 and Comparative Example 1–3.

The fabric was dyed with Kayacyl Blue BR, 5.0% owf (acid dye), using trimethyl orthoformate 1 g/l and soda ash 0.1 g/l at from 40° C. to 95° C. for 45 minutes and at 95° C. for 30 minutes (liquor ratio: 13:1), then rinsed with warm water at 50° C. for 10 minutes, followed by dye fixing.

The dye fixing was performed with a formalin condensate of dihydroxydiphenylsulfone and aromatic sulfonic acid (Nylon Super-N, Nissei Kasei) as a dye fixing agent in a proportion of 5% owf (liquor ratio: 15:1), at from 40° C. to 70° C. for 10 minutes and at 70° C. for 20 minutes. Thereafter, the knit fabric thus obtained was centrifugally dehydrated, squeezed with mangle, dried in pin tenter at 160° C. for 30 seconds and heat-set.

In Comparative Example 18, the fixation treatment was conducted as described above except the use of tannic acid as a dye fixing agent.

Example 13 and Comparative Example 19 underwent textile printing which was conducted as in the following.

After dyeing with fluorescent dyes under the same conditions as above, the fabric was subjected to printing, steaming at 100° C. for 40 minutes, and rinsing with water, alkali soaping, rinsing with warm water and rinsing with water, which steps were repeated in cycles. The dye fixation was carried out using 5% owf (liquor ratio: 15:1) formaldehyde condensate of sulfonated dihydroxydiphenylsulfone (FK 707, Fuji Kagaku) as a dye fixing agent at from 40° C. to 70° C. for 10 minutes and at 70° C. for 20 minutes, after which the fabric was dehydrated, spread, dried at 160° C. for 30 seconds and heat-set.

The chlorine-induced degradation of each knit fabric thus obtained was tested, in which the fabric was 40% warpwise drawn and immersed in chlorinated water (pH 7.5, 30° C., 30 ppm) for 6 hours, and stress before and after the immersion was measured to determine the degradation (brittleness), the results of which are summarized in Table 4.

TABLE 4

| | Ex. 11 | Ex. 12 | Ex. 13 | Comp. Ex. 14 | Comp. Ex. 15 | Comp. Ex. 16 | Comp. Ex. 17 | Comp. Ex. 18 | Comp. Ex. 19 |
|---|---|---|---|---|---|---|---|---|---|
| elastic fiber used | (A) | (A) | (A) | (A) | (A) | (A) | (A2) | (A) | (A) |
| dye fixation | A | B | H | C | D | E | F | G | I |
| residual MgO (%) | 2.5 | 2.6 | 2.5 | 0.3 | 2.5 | 0.2 | — | 2.5 | 0.2 |
| polyurethane shade change | none | none | none | none | none | none | none | yes | none |
| color fastness to water (degree) | 5 | 5 | 5 | 5 | 2 | 5 | 5 | 5 | 5 |
| color fastness to seawater (degree) | 5 | 5 | 5 | 5 | 2 | 5 | 5 | 5 | 5 |
| chlorine-induced degradation | none | none | none | yes | none | yes | yes | none | yes |

In Table 4, A to G under "dye fixation" refer to the above-mentioned dye fixation liquor supplemented with the following orthoformate or acetic acid. H and I refer to agents used during dye fixation for textile printing. In Comparative Example 15, dyeing was insufficient, namely, dye exhaustion was 0.01% owf or below.

A: Trimethyl orthoformate 0.5

B: Trimethyl orthoformate 1 g/l

C: Trimethyl orthoformate 10 g/l

D: Trimethyl orthoformate 0.005 g/l

E: Acetic acid 0.4 g/l

F: Trimethyl orthoformate 0.5 g/l

G: Trimethyl orthoformate 0.5

H: Trimethyl orthoformate 0.5 g/l

I: Acetic acid 0.4 g/l

Example 14–21, Comparative Example 20–23

In addition to the fibers as obtained in Example 1–4 and Comparative Example 1–3, 10-filament, 50 denier atmospheric cation dyeable polyester fiber (B2) which was produced by melt spinning was used as a polyester fiber to give a knit fabric.

Each gray state fabric comprised of fibers (A) and (B1) was subjected to scouring, relaxing, drying, heat setting and dyeing. The fabric was dyed in a dye bath containing trimethyl orthoformate (0.5 g/l) and Kayacyl Blue BR, 5% owf (acid dye) at a liquor ratio of 13:1 at from 40° C. to 95° C. for 30 minutes and at 95° C. for 30 minutes, after which it was rinsed with warm water at 50° C. for 10 minutes, followed by immersion of the dyed fabric in a dispersion of a chlorine-induced shade change inhibitor (Bisphenol A, 5% owf) at from 40° C. to 80° C. for 50 minutes.

Dye fixation was performed with an anionic polyphenol except tannic acid and trimethyl orthoformate as companion fixing agents. The dyed fabric thus obtained was centrifugally dehydrated, squeezed with mangle, dried in pin tenter at 160° C. and heat-set.

Example 14

The chlorinated water-induced shade change of the dyed fabric obtained as above was tested by immersing 1 part of the knit fabric in 400 parts of chlorinated water (available chlorine 100 ppm, pH 7.0) at 40° C. for 30 minutes in a manner such that the chlorinated water stream vertically hits the fabric surface. The hue of the finished union knit fabric and that after the chlorinated water treatment were measured, based on which color fastness to chlorine (degree of shade change) was estimated. The results are summarized in Table 5.

Example 15

A gray state fabric comprised of fibers (A) and (B2) was subjected to scouring, relaxing, drying, heat setting and dyeing. The fabric was dyed in dye bath containing trimethyl orthoformate (1.0 g/l) and Diacryl Brilliant Blue AC-E, 1% owf (cation dye) at a liquor ratio of 18:1 at from 40° C. to 100° C. for 45 minutes and at 100° C. for 30 minutes, after which it was rinsed with warm water at 50° C. for 10 minutes, followed by immersion of the dyed fabric in a dispersion of a chlorine-induced shade change inhibitor (Bisphenol A, 5% owf) at from 40° C. to 80° C. for 50 minutes.

The dyed union knit fabric obtained as above was subjected to the chlorinated water treatment. The results are summarized in Table 5.

Example 16

A dyed union knit fabric was prepared in the same manner as in Example 14 except that 4,4'-biphenol, 5% owf, was used as a chlorine-induced shade change inhibitor, and subjected to the chlorinated water treatment. The results are summarized in Table 5.

Example 17

A dyed union knit fabric was prepared in the same manner as in Example 14 except that 4,4'-dihydroxybenzo sulfone, 5% owf, was used as a chlorine-induced shade change inhibitor, and subjected to the chlorinated water treatment. The results are summarized in Table 5.

Example 18

A dyed union knit fabric was prepared in the same manner as in Example 14 except that 3,5-dihydroxybenzyl ethyl ketone, 5% owf, was used as a chlorine-induced shade change inhibitor, and subjected to the chlorinated water treatment. The results are summarized in Table 5.

Example 19

A dyed union knit fabric was prepared in the same manner as in Example 14 except that Bisphenol A polymer (average molecular weight 1000), 5% owf, produced by reacting Bisphenol A as a monomer with horseradish peroxidase as a catalyst, was used as a chlorine-induced shade change inhibitor, and subjected to the chlorinated water treatment. The results are summarized in Table 5.

Example 20

A dyed union knit fabric was prepared in the same manner as in Example 14 except that 4,4'-biphenol, 2% owf, was used as a chlorine-induced shade change inhibitor, and subjected to the chlorinated water treatment. The results are summarized in Table 5.

Example 21

A dyed union knit fabric was prepared in the same manner as in Example 14 except that 4,4'-biphenol, 10% owf, was used a chlorine-induced shade change inhibitor, and subjected to the chlorinated water treatment. The results are summarized in Table 5.

Comparative Example 20

A dyed union knit fabric was prepared in the same manner as in Example 14 without using a chlorine-induced shade change inhibitor, and subjected to the chlorinated water treatment. The results are summarized in Table 5.

Comparative Example 21

A dyed union knit fabric was prepared in the same manner as in Example 15 except that a chlorine-induced shade change inhibitor was not used, and subjected to the chlorinated water treatment. The results are summarized in Table 5.

Comparative Example 22

A dyed union knit fabric was prepared in the same manner as in Example 15 except that a union knit fabric comprised of fibers (A) and (B2) was used, no chlorine-induced shade change inhibitor as described above was used, and tannic acid and tartar emetic were used as chlorine-induced shade change inhibitors and dye fixing agents, and subjected to the chlorinated water treatment. The results are summarized in Table 5.

Comparative Example 23

A dyed union knit fabric was prepared in the same manner as in Example 14 except that no chlorine-induced shade change inhibitor as described above was used and tannic acid and tartar emetic were used as chlorine-induced shade change inhibitors and dye fixing agents, and subjected to the chlorinated water treatment. The results are summarized in Table 5.

Note that in all of the above-mentioned examples, not less than 80 weight % of MgO contained in the fiber (A) remained in the fiber (A) of the dyed knit fabric which underwent all treatment procedure.

TABLE 5

| | Ex. 14 | Ex. 15 | Ex. 16 | Ex. 17 | Ex. 18 | Ex. 19 | Ex. 20 | Ex. 21 | Comp. Ex. 20 | Comp. Ex. 21 | Comp. Ex. 22 | Comp. Ex. 23 |
|---|---|---|---|---|---|---|---|---|---|---|---|---|
| fiber used | (A) (B1) | (A) (B2) | (A) (B1) | (A) (B1) | (A) (B1) | (A) (B1) | (A) (B1) | (A) (B1) | (A) (B1) | (A) (B2) | (A) (B2) | (A) (B1) |
| inhibitor amount (owf) | 5% | 5% | 5% | 5% | 5% | 5% | 2% | 10% | — | — | 5% | 5% |
| shade change by inhibitor | none | none | none | none | none | none | none | none | none | none | saddened to yellow-brown | saddened to yellow-brown |
| color fastness to chlorine (degree of shade change) | 4–5 | 4–5 | 4–5 | 4–5 | 4–5 | 3 | 3 | 4–5 | 1–2 | 1–2 | 4–5 | 4–5 |

Example 22–28, Comparative Example 24–27

The fiber and the fabric as used in Example 14–21 were used except that magnesium oxide in the fiber (A) mentioned in Example 1–4 was replaced with zinc oxide. This fiber is referred to as A3.

The fabric comprised of fibers (A3) and (B2) was dyed in a dye bath (liquor ratio: 18:1) containing trimethyl orthoformate (0.5 g/l) and Diacryl Brilliant Blue AC-E (cation dye), 1% owf, at from 40° C. to 100° C. for 45 minutes and at 100° C. for 30 minutes, after which it was rinsed with warm water at 50° C. for 10 minutes, followed by application of a chlorine-induced shade change inhibitor, Bisphenol A, 5% owf, which showed 79.5 milliequivalent per gram reaction amount of chlorine as determined by the method described above, at from 40° C. to 80° C. for 50 minutes.

The knit fabric thus obtained was centrifugally dehydrated, squeezed with mangle, dried in pin tenter at 160° C. and heatset.

The chlorinated water-induced shade change of the dyed fabric obtained as above was tested by immersing 1 part of the knit fabric in 400 parts of chlorinated water (available chlorine 100 ppm, pH 7.0) at 40° C. for 30 minutes in a manner such that the chlorinated water stream vertically hits the fabric surface. The hue of the finished union knit fabric and that after the chlorinated water treatment were measured, based on which color fastness to chlorine (degree of shade change) was determined. The results are summarized in Table 6.

The examples and comparative examples were conducted using different chlorine-induced shade change inhibitors in the same manner as in the aforementioned examples and comparative examples. The results are shown in Table 6.

Note that in Example 22–28, not less than 90 weight % of zinc oxide contained in the fiber (A3) remained in the fiber (A3) of the dyed knit fabric which underwent all treatment procedure.

TABLE 6

| | Ex. 22 | Ex. 23 | Ex. 24 | Ex. 25 | Ex. 26 | Ex. 27 | Ex. 28 | Comp. Ex. 24 | Comp. Ex. 25 | Comp. Ex. 26 | Comp. Ex. 27 |
|---|---|---|---|---|---|---|---|---|---|---|---|
| fiber used | (A3) (B2) | (A3) (B2) | (A3) (B2) | (A3) (B2) | (A3) (B2) | (A3) (B2) | (A3) (B2) | (A3) (B2) | (A3) (B2) | (A3) (B2) | (A3) (B2) |
| chlorine-induced shade change inhibitor | Bis-phenol A | 4,4'-biphe-nol | 4,4'-methy-lene bis-phenol | 3,5-di-hydroxy-benzyl ethyl ketone | Bis-phenol A poly-mer | 4,4'-biphe-nol | 4,4'-biphe-nol | — | — | tannic acid, tartar emetic | tannic acid, tartar emetic |
| reaction amount of chlorine (milliequiva-lent per gram) | 79.5 | 98.7 | 94.4 | 76.1 | 56.3 | 98.7 | 98.7 | — | — | — | — |
| inhibitor amount (owf) | 5% | 5% | 5% | 5% | 0.5% | 2% | 10% | — | — | 5% | 5% |
| shade change by inhibitor | none | none | none | none | none | none | none | none | none | saddened to yellow-brown | saddened to yellow-brown |
| color fastness to chlorine (degree of shade change) | 4–5 | 4–5 | 4–5 | 4–5 | 3 | 3 | 4–5 | 1–2 | 1–2 | 4–5 | 4–5 |

What is claimed:

1. A dyed union knit fabric manufactured by dyeing a union knit fabric comprised of a plurality of yarns, at least one of the yarns comprising at least a polyurethane elastic fiber containing one or more chlorine-induced degradation inhibitors selected from the group consisting of magnesium oxide, zinc oxide, aluminum oxide, magnesium hydroxide, zinc hydroxide, aluminum hydroxide and hydrotalcite compounds in a proportion of 0.5–5.0 weight % based upon the weight of the elastic fiber and an undyed polyamide fiber, wherein the polyurethane elastic fiber of the fabric contains the one or more inhibitors in a proportion of 0.5–4.5 weight % based upon the weight of the elastic fiber and the polyamide fiber exhausts or shows a dye uptake of not less than 0.01% owf of at least one member selected from the group consisting of acid dyes, metal-complex dyes, fluorescent dyes, disperse dyes, reactive dyes, direct dyes, and cation dyes wherein there are essentially no undyed portions visible upon stretching said fabric.

2. A dyed union knit fabric according to claim 1, wherein the fabric contains at least one compound having a reaction amount of chlorine of not less than 50 milliequivalent per gram as determined by the method described in the specification in a proportion of 0.1–20% relative to the weight of the fabric.

3. A dyed union knit fabric according to claim 2, wherein the compound having a reaction amount of chlorine of not less than 50 milliequivalent per gram is selected from the group consisting of the compounds of the following formulas (I), (II) and (III)

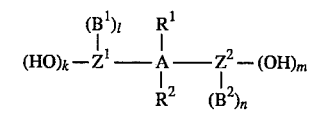

(I)

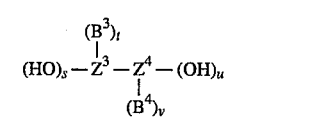

(II)

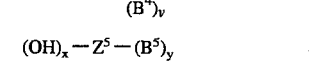

(III)

wherein $Z^1$ is an aromatic group; $Z^2$, $Z^3$, $Z^4$ and $Z^5$ are independently aromatic groups the same as or different from $Z^1$; A is a bivalent group such as alkylene, sulfonyl, sulfide and azo; $B^1$ is a monovalent group such as alkyl, alkoxy, nitro, sulfone and amino, or hydrogen atom; $B^2$, $B^3$, $B^4$ and $B^5$ are independently monovalent groups the same as or different from $B^1$, or hydrogen atom; $R^1$ and $R^2$ are the same or different and each is a group selected from the group consisting of alkyl and aryl; and k, l, m, n, s, t, u, v, x and y are positive integers satisfying the following formulas 0–1 to 0–5.

| | | |
|---|---|---|
| $0 \leqq k \leqq 4$ | $1 \leqq k+l \leqq 5$ | (Q-1) |
| $0 \leqq m \leqq 4$ | $1 \leqq m+n \leqq 5$ | (Q-2) |
| $0 \leqq s \leqq 4$ | $1 \leqq s+t \leqq 5$ | (Q-3) |
| $0 \leqq u \leqq 4$ | $1 \leqq u+v \leqq 5$ | (Q-4) |
| $1 \leqq x \leqq 4$ | $1 \leqq x+y \leqq 6$ | (Q-5) |

4. A method for manufacturing a dyed union knit fabric, wherein the pH of dye bath is maintained at not less than 4.5 throughout the dyeing process from the beginning to the end thereof when dyeing a union knit fabric comprised of at least a polyurethane elastic fiber, and a polyamide fiber and/or a cation dyeable polyester fiber, the polyurethane elastic fiber containing one or more members of the group consisting of magnesium oxide, zinc oxide, alminium oxide, magnesium hydroxide, zinc hydroxide, alminium hydroxide and hydrotalcite compounds in a proportion of 0.5–5.0 weight % based on the weight of the fiber, with at least one member dye of the group consisting of acid dyes, metal-complex dyes, fluorescent dyes, disperse dyes, reactive dyes, direct dyes and cation dyes.

5. A method for manufacturing the dyed union knit fabric according to claim 4, which comprises the use of orthoformate for dyeing.

6. A method for manufacturing the dyed union knit fabric according to claim 4, which comprises the use of an ester of alkylene glycol having an alkylene of 2 to 5 carbon atoms and formic acid for dyeing.

7. A method for manufacturing the dyed union knit fabric according to claim 4, 5 or 6, which comprises the use of an anionic phenol which does not take a quinone structure by reacting with an alkali, and orthoformate for dye fixing.

8. A dyed union knit fabric manufactured by dyeing a union knit fabric according to claim 1, the fabric further comprising an undyed cation dyeable polyester fiber.

9. A dyed union knit fabric manufactured by dyeing a union knit fabric according to claim 8, wherein the cation dyeable polyester fiber exhausts or shows a dye uptake of not less than 0.01% owf of at least one member selected from the group consisting of acid dyes, metal-complex dyes, fluorescent dyes, disperse dyes, reactive dyes, direct dyes, and cation dyes.

10. A dyed union knit fabric manufactured by dyeing a union knit fabric comprised of a plurality of yarns, at least one of the yarns comprising at least a polyurethane elastic fiber containing one or more chlorine-induced degradation inhibitors selected from the group consisting of magnesium oxide, zinc oxide, aluminum oxide, magnesium hydroxide, zinc hydroxide, aluminum hydroxide and hydrotalcite compounds in a proportion of 0.5–5.0 weight % based upon the weight of the elastic fiber and an undyed cation dyeable polyester fiber, wherein the polyurethane elastic fiber of the fabric contains the one or more inhibitors in a proportion of 0.5–4.5 weight % based upon the weight of the elastic fiber and the cation dyeable polyester fiber exhausts or shows a dye uptake of not less than 0.01% owf of at least one member selected from the group consisting of acid dyes, metal-complex dyes, fluorescent dyes, disperse dyes, reactive dyes, direct dyes, and cation dyes wherein there are essentially no undyed portions visible upon stretching said fabric.

11. A dyed union knit fabric manufactured by dyeing a union knit fabric according to claim 10, the fabric further comprising an undyed cation dyeable polyester fiber.

12. A dyed union knit fabric prepared by a method comprising contacting a union knit fabric with a dye bath, wherein the pH of the dye bath is maintained at not less than 4.5 throughout the dyeing process from the beginning to the end thereof when dyeing the union knit fabric, the union knit fabric comprised of a plurality of yarns, at least one of the yarns comprising at least a polyurethane elastic fiber and an undyed second fiber selected from the group consisting of a polyamide fiber, a cation dyeable polyester fiber, and combinations thereof, the polyurethane elastic fiber containing one or more chlorine-induced degradation inhibitors of the group consisting of magnesium oxide, zinc oxide, aluminum oxide, magnesium hydroxide, zinc hydroxide, aluminum hydroxide and hydrotalcite compounds in a proportion of 0.5–5.0 weight % based upon the elastic fiber with at least one member dye of the group consisting of acid dyes, metal-complex dyes, fluorescent dyes, reactive dyes, direct dyes, and cation dyes, the obtained dyed union knit fabric having the polyurethane containing the one or more inhibitors in a proportion of 0.5–4.5 weight % based upon the elastic fiber and at least one of the polyamide and the polyester exhausting or showing a dye uptake of not less than 0.01 owf of the dyes wherein there are essentially no undyed portions visible upon stretching said fabric.

13. The dyed union knit fabric according to claim 12, wherein prior to dyeing, the polyurethane elastic fiber contains one or more members selected from the group consisting of magnesium oxide, aluminum oxide, magnesium hydroxide, aluminum hydroxide and hydrotalcite compounds.

14. The dyed union knit fabric according to claim 1, wherein prior to dyeing, the polyurethane elastic fiber contains one or more members selected from the group consisting of magnesium oxide, aluminum oxide, magnesium hydroxide, aluminum hydroxide and hydrotalcite compounds.

15. The dyed union knit fabric according to claim 10, wherein prior to dyeing, the polyurethane elastic fiber contains one or more members selected from the group consisting of magnesium oxide, aluminum oxide, magnesium hydroxide, aluminum hydroxide and hydrotalcite compounds.

* * * * *

UNITED STATES PATENT AND TRADEMARK OFFICE

CERTIFICATE OF CORRECTION

PATENT NO. : 5,456,960

DATED : October 10, 1995

INVENTOR(S) : Ido et al.

It is certified that error appears in the above-indentified patent and that said Letters Patent is hereby corrected as shown below:

On the title page, item [22]
The correct filing date should read July 21, 1994.
In column 7, line 51 "100 mi" should read --100 ml--.
In column 8, line 45 "C=axf+S (2)" should read --C=axf÷S (2)--.
In column 9, line 35, "60° to 90°C" should read --60°C to 90°C--.
In column 10, line 6, "denlet" should read --denier--.

Column 19, lines 37 and 38 claim 3 "0-1 to 0-5" should read --Q-1 to Q-5--.

Signed and Sealed this

Second Day of July, 1996

Bruce Lehman

*Attest:*

BRUCE LEHMAN

*Attesting Officer*

*Commissioner of Patents and Trademarks*